United States Patent [19]

Agiman

[11] Patent Number: 4,897,594

[45] Date of Patent: Jan. 30, 1990

[54] HIGH GAIN DRIVER CIRCUIT AND METHOD

[75] Inventor: Dan Agiman, Lewisville, Tex.

[73] Assignee: Texas Instruments Incorporated, Dallas, Tex.

[21] Appl. No.: 336,625

[22] Filed: Apr. 6, 1989

Related U.S. Application Data

[63] Continuation of Ser. No. 118,710, Nov. 9, 1987, abandoned.

[51] Int. Cl.[4] ..... G05F 1/575

[52] U.S. Cl. ..... 323/273; 323/280; 323/901

[58] Field of Search ..... 323/273–276, 323/280, 317, 901; 361/187

[56] References Cited

U.S. PATENT DOCUMENTS

| | | | |
|---|---|---|---|
| 3,235,787 | 2/1966 | Gordon et al. | 323/273 |
| 3,629,691 | 12/1971 | Wheatley | 307/297 |
| 3,753,078 | 8/1973 | Hedel | 323/273 |
| 4,085,359 | 4/1978 | Ahmed | 363/49 |
| 4,179,649 | 12/1979 | Karlin et al. | 323/901 |
| 4,338,646 | 7/1982 | Davis et al. | 361/18 |
| 4,476,428 | 10/1984 | Iwasawa | 323/901 |
| 4,672,302 | 6/1987 | Deshazo et al. | 323/277 |
| 4,684,878 | 8/1987 | Giordano | 323/279 |
| 4,704,572 | 11/1987 | Melbert | 323/275 |

FOREIGN PATENT DOCUMENTS

| | | | |
|---|---|---|---|
| 121287 | 10/1984 | European Pat. Off. . | |
| 3504200 | 8/1986 | Fed. Rep. of Germany . | |
| 57-312 | 2/1984 | Japan | 323/273 |
| 432476 | 11/1974 | U.S.S.R. | 323/276 |
| 1579326 | 11/1980 | United Kingdom | 323/279 |

*Primary Examiner*—William H. Beha, Jr.

*Attorney, Agent, or Firm*—George L. Craig; Thomas W. DeMond; Melvin Sharp

[57] ABSTRACT

Circuitry for providing unlimited, self-adjusted drive current and suitable for power applications is described. A four terminal high efficiency, high gain driver circuit including enabling circuitry is provided along with a positive feedback loop that is designed to provide unlimited drive current which automatically adjusts to the load requirement. The drive circuit includes a startup transistor, drive regulation transistors, predrive transistors, a driving or output transistor, and a current splitter. The drive regulation transistors and the current splitter provide a positive feedback loop which supplies current to the predrive transistors and the driving transistor. Under typical loading conditions, feedback loop operation will cause the collector to emitter voltage of the driving transistor to decrease which causes the drive regulation transistors to saturate. This condition decreases positive feedback loop drive which in turn regulates the predrive current to the level required by the load. Under short circuit output conditions, the drive regulation transistors, together with the current splitter and the sensing resistor, regulate the output drive current to a predetermined level.

20 Claims, 3 Drawing Sheets

HIGH GAIN DRIVER CIRCUIT AND METHOD

This application is a Continuation, of application Ser. No. 118,710, filed Nov. 9, 1987 now abandoned.

BACKGROUND OF THE INVENTION

The present invention relates to electronic circuits and more specifically, to methods and circuitry for optimizing the operating characteristics of driver designs which function efficiently and independently of loading conditions.

Driver circuits or digital peripheral drivers may be described as interface devices which are frequently employed to switch high current, high voltage loads in response to standard digital logic input signals. Examples of such loads may include relays, solenoids, lamps, or other peripheral circuit elements.

In any driver circuit design, one of the most important design considerations is the conservation of drive current to an output transistor. This requires a careful analysis of numerous worst case conditions including process variations which affect a change in transistor beta or resistor values, as well as the effects of temperature and voltage variations on transistor betas, resistor values, and base to emitter voltages (Vbe). Once these conditions are well understood, a circuit designer may elect to implement a circuit which demonstrates a drive current having a value of the worst case drive current plus a 50% overdrive.

While the above approach to designing driver circuits guarantees operation within the range of anticipated variations, the resulting circuits generate excessive drive currents under optimum operating conditions as well as undesirable power dissipation. Moreover, many power drivers in the past have been designed to have current ratings which are two to four times the actual load which results in even further excessive waste of current. Finally, driver circuits are typically designed to operate with a particular load. Any change of loading condition to such designs may result in undesirable operating characteristics. Namely, replacing the "designed load" with one that requires less drive current is at best inefficient, while substituting a load that requires greater drive current may render the driver insufficient. In the later situation, the driver may in fact come out of the saturated state and dissipate excessive power. This in turn may cause a thermally generated loss of functionality if the device is thermally protected and a catastrophic device failure if it is not.

Accordingly, a need has arisen for a high efficiency, high gain driver circuit that is suitable for power applications. In particular, a need has arisen for a driver circuit that optimizes the utilization of drive current for a variety of loading conditions. Such a driver circuit should ideally be suitable for implementation in integrated circuit form and capable of fulfilling the need for such a design in a broad variety of applications including high power automotive and portable equipment operating environments.

It is a primary object of this invention to provide an improved current driver circuit which provides unlimited drive current that is self adjusted to the load requirements and which employs over current limiting. Another object is to provide a current driver circuit which may be used for both high and low side driver applications. Yet another object is to provide a current driver circuit which dissipates minimal power and reduced standby current. Finally, it is a further object to provide a current driver circuit that requires no input current to turn off.

SUMMARY OF THE INVENTION

In accordance with the present invention, there is provided a four terminal, high efficiency, high gain driver circuit suitable for power application and which exhibits optimum operating characteristics independently of circuit loading conditions. This advantage and others are accomplished by providing a driver design having overcurrent limiting, a self-adjust predriver and minimal standby current. A startup transistor initiates a positive feedback loop that effects the turn-on of drive regulation transistors, predrive transistors, and finally a drive or output transistor. As the drive regulation transistors are driven beyond the level required for a given load, the collector to emitter voltage of the driving transistor decreases causing the drive regulation transistors to saturate. As a result, the input drive to the positive feedback loop is reduced and the drive current provided by the drive regulation transistors is automatically tailored to the load. Under current limiting conditions, the drive regulation transistors in conjunction with a current splitter and current sensing resistor operate to reduce the positive feedback loop drive and limit the load current.

In addition to initiation of circuit operation by the startup transistor, the control transistors together with the start-up transistor and control resistor provide a means to disable the positive feedback loop in the absence of a source of current to the control pin. Furthermore, current supplied from the current splitter is available to assist in driving the control transistors in the event that it is desirable to turn the driving circuit off from a conducting condition. Finally, by providing current to the control input, positive feedback loop operation is initiated by the start-up transistor as described above.

The driver circuit of the present invention is suitable for both low and high side driver applications. In high side applications, the circuit will provide a source of current to any load while in low side system designs the same circuit may be driven by any load. It is therefore possible to implement the driver circuit in a very broad range of applications.

BRIEF DESCRIPTION OF THE DRAWINGS

Further features and advantages of the invention will become apparent from the description of the following embodiment, taken in conjunction with the accompanying drawings, in which.

DETAILED DESCRIPTION OF THE PREFERRED EMBODIMENT

Figure 1:
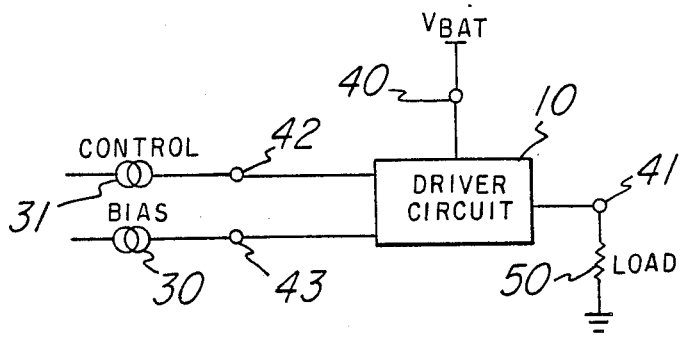
FIG. 1 is a block diagram of the four terminal driver circuit of the present invention showing external bias and output connections for a high side application.

Referring first to FIG. 1, there is shown a block diagram of the four terminal driver circuit including the external bias arrangement for a high side driver application. As will be described in detail below, current sources 30 and 31 provide the current necessary to enable the driver circuit by activating an appropriate startup transistor. Terminal 40 labeled VBAT is coupled to a suitable source of supply voltage. For example, in an automotive application this terminal may be connected to the battery voltage supply. Terminal 41 is connected to the load 50 which may be, for example, a lamp or any electrical device requiring current drive. As is apparent from the arrangement wherein the load 50 is coupled between terminal 41 and ground, driver circuit 10 provides the necessary current source to meet the operational requirements of the load device.

Figure 2:
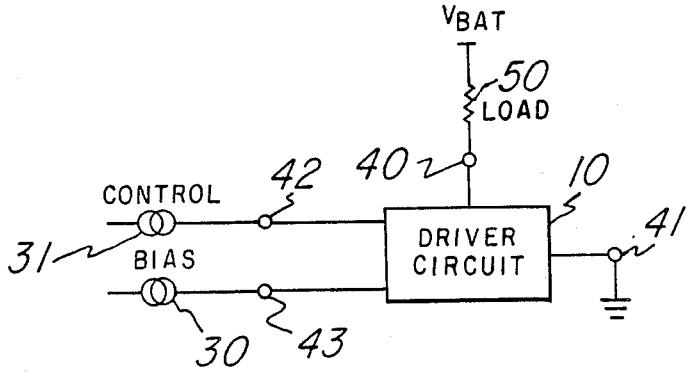
FIG. 2 is a block diagram of the four terminal driver circuit of the present invention showing external bias and output connections for a low side application.

Referring next to FIG. 2, there is shown a block diagram of the four terminal driver circuit including the external bias arrangement for a low side driver application. All elements and operation remain as described above for FIG. 1 with the exception that circuit 10 is driven by the load 50 which is coupled between terminal 40 and a source of supply, and terminal 41 is coupled to circuit ground. In this low side application, driver circuit 10 provides the same features and advantages that are present in the high side arrangement of FIG. 1. It should be obvious that an immediate advantage to the design of driver circuit 10 is the ability to connect the same circuit into either high or low side applications.

Figure 3:
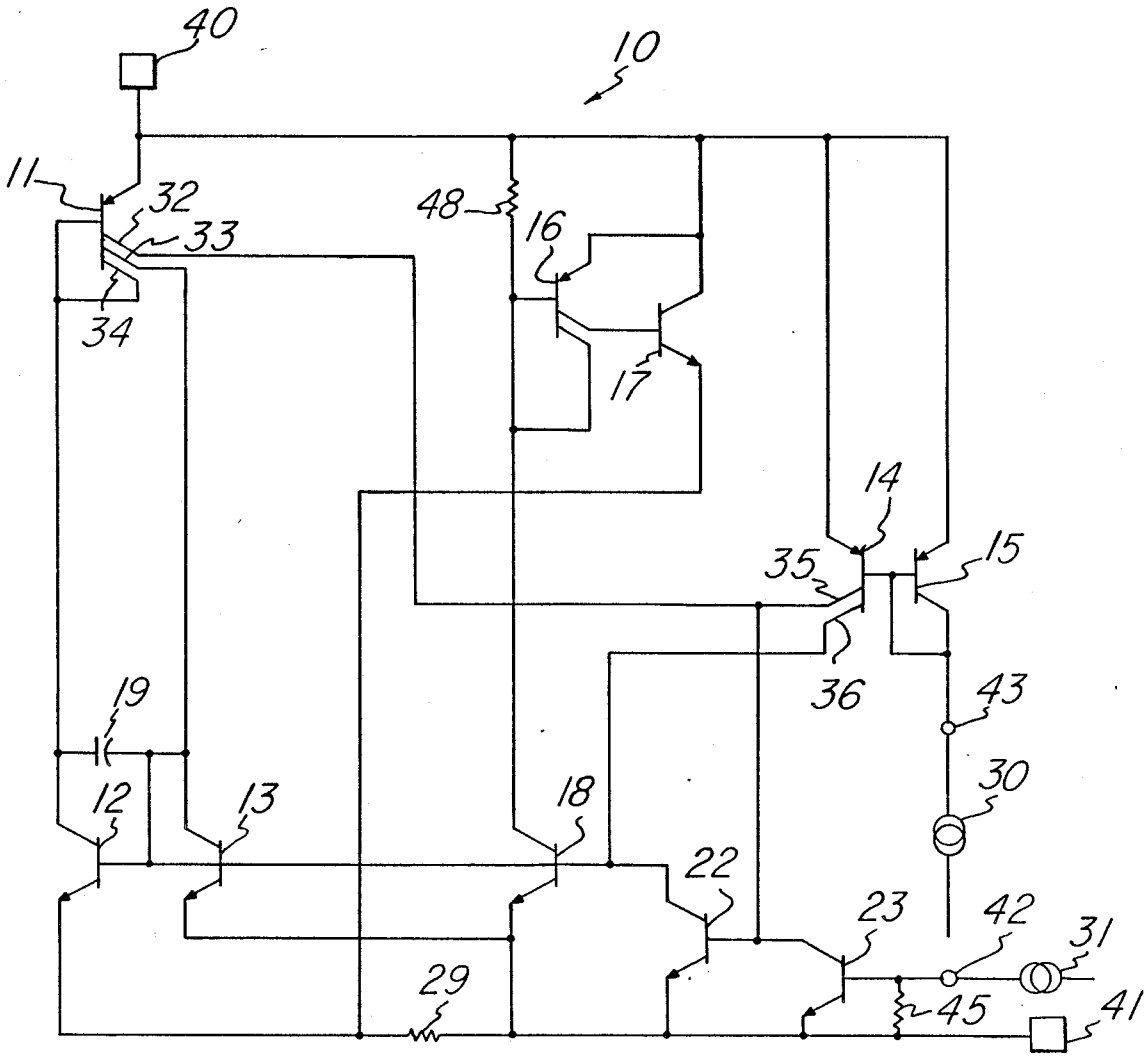
FIG. 3 is a schematic diagram representing a preferred embodiment of the high gain driver circuit of the present invention.

Referring now to FIG. 3, there is shown a schematic diagram of the preferred embodiment of the present invention. Terminal 40 is connected to the emitter of startup PNP transistor 14 which has its base connected to the base of bias PNP transistor 15 as well as terminal 43. The emitter of bias transistor 15 is also connected to terminal 40. As described above, in operation terminal 43 is connected to an external bias source 30. Terminal 43 is also connected to the collector of bias transistor 15. Startup transistor 14 is a dual collector transistor having a collector 35 connected to the collector 32 of multiple collector current splitter transistor 11. Collector 35 of startup transistor 14 is connected to the collector of a first enabling control transistor 23 and also to the base of a second enabling control transistor 22. In addition, the base of transistor 23 is connected to control terminal 42 and one end of resistor 45 having a second end connected to terminal 41. The emitter of transistor 23 is also connected to terminal 41. In application, control terminal 42 is connected to a suitable source of control current 31 from external logic.

Referring again to startup transistor 14, the second collector 36 is connected to the base of a first predrive transistor 18 and the collector of transistor 22 which has an emitter connected to terminal 41. In addition, transistor 18 has an emitter connected to output terminal 41 as well as the emitter of a first drive regulation transistor 13. The collector of transistor 18 is connected to both the base and a first collector of a second predrive transistor 16 which has an emitter connected to both terminal 40 and the collector of the driving transistor 17. Transistor 16 has a second collector connected to the base of transistor 17. The base of transistor 16 is connected to one end of a resistor 48 having a second end connected to terminal 40. The emitter of driving transistor 17 is connected to one end of current sensing resistor 29 having a second end connected to terminal 41. The emitter of transistor 17 is also connected to the emitter of a second drive regulation transistor 12 which has a base connected to the bases of both transistor 13 and transistor 18. In addition, the base of transistor 12 is connected to the collector of transistor 13 , a second collector 33 of current splitter transistor 11, and one end of compensation capacitor 19 which has a second end connected to the collector of transistor 12. The collector of second drive regulation transistor 12 is also connected to the base of current splitter transistor 11 and a collector 34 of transistor 11. Finally, the emitter of PNP transistor 11 is connected to terminal 40.

Assuming normal load conditions for the high side driver application of FIG. 1, the operation of the driver circuit 10 of FIG. 3 will now be described in detail. Circuit 10 is enabled by providing a suitable source of voltage to terminal 40, a source of current 30 to bias terminal 43, and a source of current 31 to control terminal 42. The load to be driven by circuit 10 may be connected between terminal 41 and system ground for the high side design. Under the above conditions, startup transistor 14 will turn on and provide drive current to the base of first predrive transistor 18 as well as drive regulation transistors 12 and 13. By providing a source of current to terminal 42, the first control transistor 23 turns on which in turn keeps second control transistor 22 off allowing start-up transistor 14 to adequately drive transistors 18, 13 and 12.

In the conducting operating mode described above, drive regulation transistors 12 and 13 in conjunction with current splitter transistor 11 provide a positive feedback loop which supplies drive current to driving transistor 17 by driving the predrive transistors 16 and 18. Under typical loading conditions, start-up transistor 14 initiates the turn on of predrive transistor 18, and drive regulation transistors 12 and 13. Current splitter transistor 11 provides equal levels of current from collectors 33 and 34 to transistors 12 and 13; however, since transistor 12 is a larger area device, it will carry as much as four times the current of transistor 13. Transistor 18 may also be made larger in area than transistor 13 and functions to amplify the feedback loop current. As an example, transistor 18 may be designed to carry ten times the current carrying capacity of transistor 13. Capacitor 19 is coupled between the base-collector of transistor 12 and serves to reduce the high frequency loop gain to prevent unwanted oscillations. As the demand for load current increases, transistor 18 will continue to provide increased levels of drive to transistors 16 and 17. Once these devices are driven beyond the level required by a given load, their collector to emitter voltages are reduced, causing a reduction in the collector-emitter voltage of predrive transistor 18. As this voltage drops below the base-emitter voltage of transistor 18, the base current will begin to flow into the collector which in turn reduces the current drive to drive regulation transistors 12 and 13. It should be obvious that under these conditions the positive feedback loop action is diminished and the load current provided by driving transistor 17 is self-adjusted to the requirements of the load.

Referring now to the condition where the load approaches a short circuit or a direct connection of terminal 41 to system ground, current driving circuit 10 will operate in the following manner. As large amounts of current are demanded, transistor 12 is also turned on to provide additional current to the load through current sensing resistor 29. As mentioned previously, transistors 12 and 13 may be sized such that transistor 12 has a Vbe that is smaller than the Vbe of transistor 13 by, for example, a factor of four for equal collector currents. Current splitter transistor 11 provides equal amounts of current from collectors 33 and 34 to provide the current source for both transistors 12 and 13. Under these conditions, transistor 12 conducts a greater amount of current than transistor 13. As current begins to flow to the load from drive transistor 17 and conducting drive regulation transistor 12, a voltage drop is established across current sensing resistor 29. When this voltage drop exceeds the difference in Vbe between transistors 12 and 13, transistor 13 will increasingly conduct and divert drive current from the base of transistor 18. This results in a reduction in the base drive to transistor 16 and driving transistor 17 which regulates the output current level. For the above described conditions, the output current will be limited to the Vbe of transistor 13 minus the Vbe of transistor 12 divided by the resistance of current sensing resistor 29.

Current driving circuit 10 may be conveniently disabled by the operation of control transistors 22 and 23, control resistor 45, startup transistor 14, and current splitter transistor 11. By removing he source of current 31 to control terminal 42, control transistor 23 will be turned off. Control resistor 45 references the base of transistor 23 to its emitter to ensure the off condition. With transistor 23 in a non-conducting state, a second control transistor 22 will turn on as base drive is provided by collector 35 of start-up transistor 14. This results in the removal of base drive from transistor 18 which inhibits feedback loop operation and disables driving circuit 10. Under operating conditions wherein circuit 10 was previously on, collector 32 of transistor 11 will provide additional current drive to the base of transistor 22 to ensure that the positive feedback loop is turned off. To again initiate the operation of circuit 10, current source 31 is applied to control terminal 42 which turns the first control transistor 23 on and turns the second control transistor off. Circuit operation is thereafter as described above.

It should be apparent from the foregoing discussion that a particular advantage to the present design is that no control current is required to disable the current driver circuit 10. In addition, minimal standby current, for example less that 10 microamps, is required in the off condition. Moreover, during operation circuit 10 provides only that current necessary to drive a given load and therefore exhibits optimal power supply to ground current levels as well as reduced sensitivity to power supply voltage variations. Reduced power dissipation is made possible by the fact that current driving transistor 17 is maintained in a low "ON" state.

In certain applications, it may be desirable to employ the current driver circuit 10 in the low side driver configuration of FIG. 2. In this case the circuit of FIG. 3 may be externally connected as follows. As shown in FIG. 2, the load 50 is connected from a source of supply voltage (Vbat) to terminal 40, terminal 41 is connected to circuit ground and control and bias sources 31 and 30 are respectively connected to terminals 42 and 43 as in the high side driver application described above. Control and operation of driver circuit 10 are as previously described for the high side application. In low side driver designs, the load will provide a source of current to driver circuit 10. Load current will be tailored to suit the given loading conditions as described above.

Figure 4:
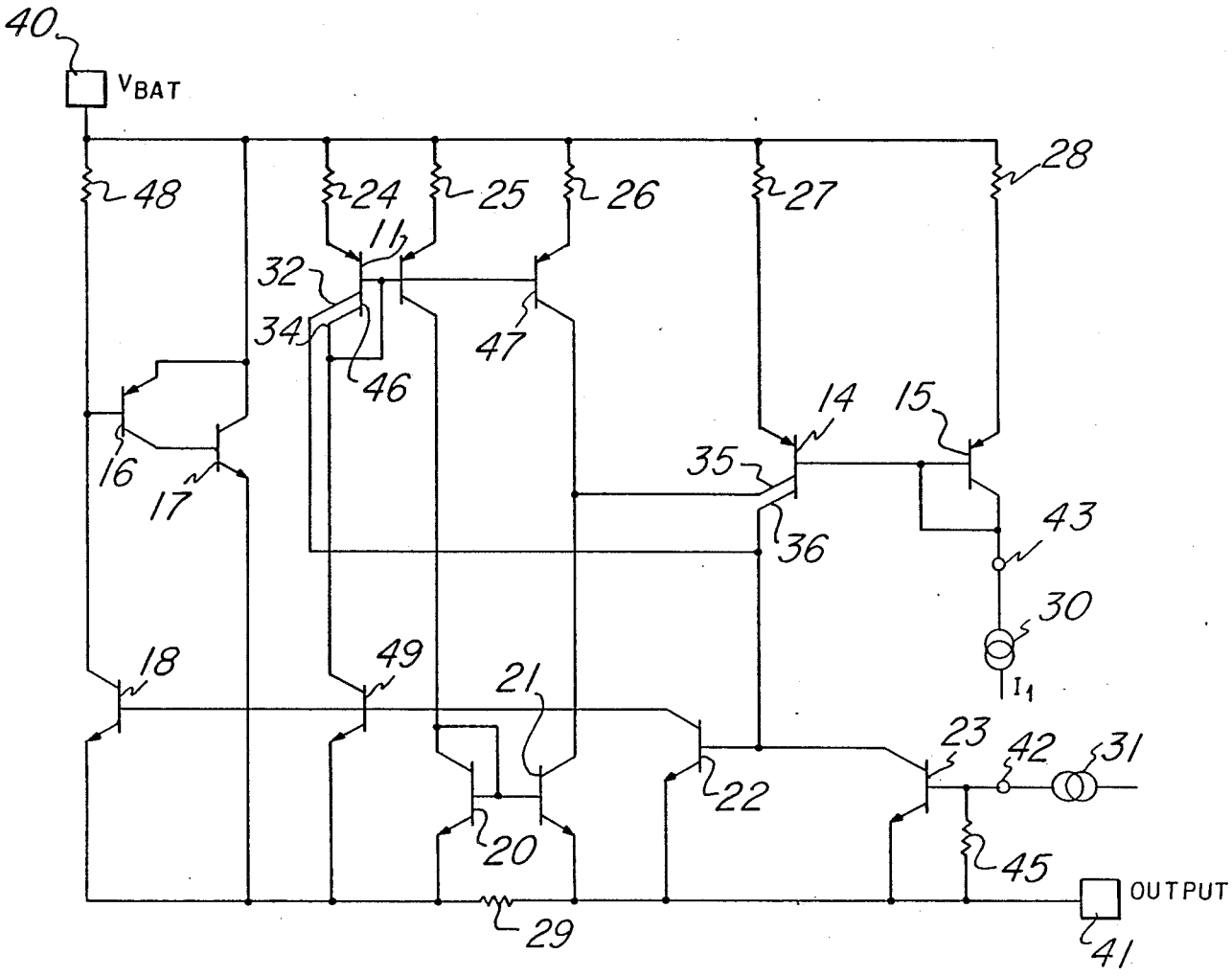
FIG. 4 is a schematic diagram of an alternative embodiment of the present invention.

Referring next to FIG. 4 there is shown an alternative embodiment of the present invention. The same reference numerals are given to those elements that function as in the previously described FIG. 3 embodiment. In the design of FIG. 4, terminal 40 is coupled to the emitter of startup transistor 14 through startup resistor 27 and also the emitter of bias transistor 15 through bias resistor 28. The collector-base of transistor 15 is connected to terminal 43 to which an external bias source 30 is connected during circuit operation. The base of transistor 15 is connected to the base of startup transistor 14 which is a dual collector PNP transistor having a first collector 36 connected to the collector of a first control transistor 23 and also a first collector 32 of dual collector transistor 11. Transistor 14 also has a second collector 35 connected to the collector of PNP transistor 47 and the collector of NPN transistor 21. Control transistor 23 has a base connected to terminal 42 and one end of a resistor 45 having a second end connected to terminal 41. During operation, terminal 42 is connected to an external current source 31. The collector of transistor 23 is connected to the base of a second control transistor 22 and the emitters of both control transistors 22 and 23 are connected to terminal 41. The collector of transistor 22 is connected to a first regulation transistor 21 having an emitter connected to terminal 41 as well as one end of current sensing resistor 29. The other end of current sensing resistor 29 is connected to the emitter of a second regulation transistor 20 as well as the emitters of transistor 49, predrive transistor 18 and driving transistor 17. The base of transistor 20 is connected to its collector, to the collector of transistor 46, and also to the base of transistor 21.

Referring again to the regulation transistor 21, it is seen that the collector is also connected to the bases of both transistor 49 and predrive transistor 18. The collector of transistor 49 is connected to both the base and a second collector 34 of current source transistor 11. The first collector 32 is connected to both collector 36 of transistor 14 and the collector of control transistor 23. Transistors 11 46 and 47 all have emitters coupled to terminal 40 through a current splitter resistor 24, a gain resistor 25, and a drive resistor 26 respectively.

Finally, predrive transistor 18 has a collector connected to the base of a second predrive transistor 16 and also to one end of a resistor 48 having a second end connected to terminal 40. The emitter of PNP transistor 16 is connected to terminal 40 as well as the collector of NPN driving transistor 17. The collector of predrive transistor 16 is connected to the base of driving transistor 17.

Operation of the circuit 10 of FIG. 4 is similar to that of the circuit of FIG. 3 and will be described for the high side driver application of FIG. 1. The comments relating to the low side driver application for the preferred embodiment apply and will not be repeated here.

Referring again to FIG. 4, the operation of driver circuit 10 begins by startup transistor conducting upon the application of a suitable source of supply voltage to terminal 40, and current sources to both terminals 43 and 42. The desired load is connected between terminal 41 and system ground. Under these conditions the first control transistor 23 is conducting which prevents the turn on of transistor 22 and allows the collector 35 of startup transistor 14 to drive the bases of both transistor 49 and 18 turning these devices on and establishing a positive feedback loop that turns on predrive transistor 16 and driving transistor 17. As the first predriver transistor 18 is driven beyond that level required by the selected load, the collector to emitter output voltage of transistor 17 decreases causing predrive transistor 18 to saturate and divert base drive from transistor 49. In this manner, the input to the positive feedback loop is reduced and output current from drive transistor 17 is automatically established at just that level required by the load. It should be noted that by ratioing the values of bias resistor 28 and startup resistor 27, the bias current required from bias source 30 may be reduced and power consumption optimized. Increasing the value of resistor 28 will accomplish a reduction in the bias current level.

Under current limiting or short circuit load conditions, regulation transistors 20 and 21 in conjunction with current sensing resistor 29 operate to regulate the output current. Transistor 20 may, for instance, be designed to have a larger area than transistor 21 and initially will conduct a larger amount of current. Transistors 46 and 47 provide a source of current to the collectors of transistors 20 and 21 which operate to increase feedback loop gain and circuit response time. As the voltage drop across current sensing resistor 29 increases, transistor 21 conducts greater amounts of current and diverts base drive from the positive feedback loop described above. As a result, current is limited to a desirable level.

The operation of control transistors 22 and 23 to enable circuit 10 is the same as described in the description of the preferred embodiment of FIG. 3 and will not be repeated. It is noted that again it is not necessary to apply a source of current to control terminal 42 to disable the driver circuit and standby current is minimal. Furthermore, current supplied from the collector 34 of transistor 11 is available to assist in driving the base of transistor 22 in the event that it is desirable to turn the driving circuit off from a conducting condition.

Having described the invention in connection with certain specific embodiments thereof, it is to be understood that further modifications may now suggest themselves to those skilled in the art and it is intended to cover such modifications as fall within the scope of the appended claims.

We claim:

1. A circuit for controlling current to a load device comprising:

a driving transistor coupled between a source of supply voltage and an output terminal, said driving transistor having a control electrode for receiving drive current;

at least one predrive transistor having an output coupled to said control electrode of said driving transistor, an input terminal for receiving a startup signal and another terminal coupled to said output terminal;

a startup circuit for providing said startup signal having an output coupled to said input terminal of said at least one predrive transistor and a control terminal for receiving a source of bias current; and a feedback circuit coupled between said source of supply voltage and said output terminal and having an input coupled to said input terminal, said feedback circuit comprising circuitry for sensing the level of current supplied by said driving transistor and for controlling the current to said input terminal in response to the circuitry for sensing to control the level of said drive current.

2. A circuit as recited in claim 1, further comprising a control circuit having an input for receiving a control signal and an output coupled to said output of said startup circuit for disabling said positive feedback circuit when said control signal is at a selected level.

3. A circuit as recited in claim 1, wherein said startup circuit comprises:

a startup transistor having an output terminal coupled to said input terminal of said at least one predrive transistor and an input terminal coupled to said bias terminal; and a bias transistor having an output terminal coupled to said bias terminal and an input terminal coupled to said input terminal of said startup transistor for controlling the amount of current provided to said startup transistor.

4. A circuit as recited in claim 1, wherein said startup circuit comprises:

a startup transistor having a collector coupled to said input terminal of said at least one predrive transistor, a base coupled to said bias terminal, and an emitter coupled to one end of a startup resistor having a second end coupled to said source of supply voltage; and a bias transistor having a base and a collector coupled to said bias terminal, and an emitter coupled to one end of a bias resistor having a second end coupled to said source of supply voltage, the resistance values of said bias resistor and said startup resistor being ratioed to provide a selected level of bias current to said startup circuit.

5. A circuit as recited in claim 1, further including a control circuit comprising:

a first control transistor having an output terminal and an input terminal for receiving a control signal; and a second control transistor having a control terminal coupled to said output terminal of said first control transistor and an output terminal coupled to said control electrode of said at least one predrive transistor.

6. A circuit as recited in claim 1, wherein said feedback circuit comprises:

a current splitter transistor having an emitter coupled to a source of supply voltage, and first and second collectors for providing equal collector current levels;

a first drive regulation transistor having a collector coupled to said first collector, a base coupled to said control electrode of said at least one predrive transistor and an emitter coupled to said output terminal; and a second drive regulation transistor having a collector coupled to said second collector, a base coupled to said base of said first drive regulation transistor and an emitter coupled to said output terminal.

7. A circuit as recited in claim 1, wherein said feedback circuit comprises:

a first drive regulation transistor having a collector coupled to a source of supply current, a base coupled to said control electrode of said at least one predrive transistor, and an emitter coupled to one end of a current sensing resistor which has a second end coupled to said output terminal; and a second drive regulation transistor having a collector coupled to said source of supply current, a base coupled to said base of said first drive regulation transistor and an emitter coupled to said output terminal, said current sensing resistor providing for a current limiting condition when said load device is short circuited.

8. A circuit as recited in claim 1, wherein said feedback circuit comprises:

a current splitter transistor having an emitter coupled to said source of supply voltage, first, second and third collectors for providing equal levels of collector current, and a base coupled to said first collector;

a first drive regulation transistor having a collector coupled to said first collector, a base coupled to said control electrode of said at least one predrive transistor and an emitter coupled to one end of a current sensing resistor having a second end coupled to said output terminal; and a second drive regulation transistor having a collector coupled to said second collector, a base coupled to said base of said first drive regulation transistor and an emitter coupled to said output terminal, wherein said current sensing resistor provides for current limiting under short circuit load conditions and said third collector is coupled to a control circuit responsive to a control signal to assist in turning off said feedback circuit.

9. A circuit as recited in claim 1, wherein said feedback circuit comprises:

a first drive regulation transistor having a collector coupled to a source of supply current, a base coupled to said control electrode of said at least one predrive transistor, and an emitter coupled to said output terminal; and a second drive regulation transistor having an emitter with an area larger than the emitter area of said at least one predrive transistor and coupled to said output terminal, a base coupled to said base of said first drive regulation transistor and a collector coupled to said source of supply current.

10. A circuit as recited in claim 1, wherein said feedback circuit comprises:

a first drive regulation transistor having a collector coupled to a source of supply current, a base coupled to said control electrode of said at least one predrive transistor, and an emitter coupled to one end of a current sensing resistor having a second end coupled to said output terminal;

a second drive regulation transistor having an emitter with an area larger than the emitter area of said at least one predrive transistor, said emitter being coupled to said output terminal, a base coupled to said base of said first drive regulation transistor and a collector coupled to said source of supply current, said current sensing resistor providing for a predetermined level of drive current under short circuit output conditions.

11. A circuit as recited in claim 1, further including a regulation circuit comprising: a first regulation transistor having a base and a collector coupled to a source of supply current, and an emitter coupled to one end of a current sensing resistor having a second end coupled to said output terminal; and a second regulation transistor having a base coupled to said base of said first regulation transistor, a collector coupled to said source of supply current and an emitter coupled to said output terminal, said second regulation transistor reducing the current drive to said positive feedback circuit to limit current to said output terminal under short circuit conditions.

12. A circuit for controlling current through a load device comprising:

a driving transistor coupled between a source of supply voltage and an output terminal, said transistor having a base electrode for receiving drive current;

a first predrive transistor having an output coupled to said base electrode and a control electrode responsive to a predrive signal;

a second predrive transistor for providing said predrive signal having a collector coupled to said control electrode, an emitter coupled to said output terminal, and a base terminal responsive to a bias signal; and a second drive regulation transistor for providing current to said load device, said second drive regulation transistor having an emitter, a base coupled to said base of said at least one drive regulation transistor, and a collector coupled to said current source; and a current sensing device for sensing current supplied to said load device having one end coupled to said emitter of said second drive regulation transistor and having a second end coupled to said output terminal, said current sensing resistor providing a selected voltage to enable said at least one drive regulation transistor and limit the current provided by said driving transistor in response to increasing current demand by said load device.

13. A circuit as recited in claim 12, further comprising a control circuit having an input for receiving a control signal and an output coupled to said base terminal for disabling said feedback circuit when said control signal is at a logic low level.

14. A circuit as recited in claim 12, wherein said startup signal is provided by a bias circuit comprising:

a bias transistor having a collector and a base coupled to a source of bias current, and an emitter coupled to said source of supply voltage; and a startup transistor having an emitter coupled to said source of supply current, a base coupled to said source of bias current and a collector coupled to said base terminal.

15. A method for controlling current through a load device comprising:

providing current to said load device from a current driving transistor coupled between a supply voltage and said load device;

providing current to said load device from a first drive regulation transistor coupled between a source of current and said load device;

sensing the amount of current provided to said load device; and controlling the current provided to said load device by providing current to said load device from a second drive regulation transistor having a collector coupled to said source of current, an emitter coupled to said load device and a base coupled to an input to said current driving transistor, said second drive regulation transistor providing for increased levels of current as required by said load device and reducing drive current to said driving transistor when the amount of current sensed by said step of sensing exceeds a selected level.

16. A method as recited in claim 15, further comprising providing current to said current driving transistor from a startup circuit coupled between said supply voltage and said input to said current driving transistor, said startup circuit being responsive to a bias current.

17. A method as recited in claim 15, further comprising controlling the turn-on of said current driving circuitry by providing a control circuit having an output coupled to said input to said current driving transistor and an input coupled to a source of control current.

18. A circuit for controlling current to a load device comprising:

a driving transistor coupled between a source of supply voltage and an output terminal, said driving transistor having a control electrode for receiving drive current;

at least one predrive transistor having an output coupled to said control electrode of said driving transistor, an input terminal for receiving a startup signal, and another terminal coupled to said output terminal;

a startup circuit for providing said startup signal having first and second outputs, said first output being coupled to said input terminal of said at least one predrive transistor and a control terminal for receiving bias current;

a feedback circuit coupled between said source of supply voltage and said output terminal and having an input coupled to said input terminal, said feedback circuit comprising circuitry for sensing the current supplied by said driving transistor for controlling the level of current to said input terminal in response to the circuitry for sensing to provide the level of drive current required by said load device; and a control circuit having an input for receiving a control signal and an output coupled to said second output of said startup circuit for disabling said feedback circuit when said control signal is at a selected level.

19. A circuit as recited in claim 18, wherein said control circuit comprises:

a first control transistor having an output electrode and an input electrode for receiving said control signal; and a second control transistor having a control terminal coupled to said output electrode of said first control transistor and an output terminal coupled to said input terminal of said at least one predrive transistor.

20. A circuit as recited in claim 18, wherein said feedback circuit comprises at least one drive regulation transistor having a collector coupled to a current source, an emitter coupled to said output terminal and a base coupled to said input terminal of said at least one predrive circuit.

* * * * *